US008333672B2

(12) United States Patent
Nagler

(10) Patent No.: US 8,333,672 B2
(45) Date of Patent: Dec. 18, 2012

(54) BALL-STRIKING IMPLEMENT

(75) Inventor: Hubert Nagler, Hollabrunn (AT)

(73) Assignee: Tec Sportmanagement AG, Zug (CH)

( * ) Notice: Subject to any disclaimer, the term of this patent is extended or adjusted under 35 U.S.C. 154(b) by 178 days.

(21) Appl. No.: 12/667,641

(22) PCT Filed: Jun. 12, 2008

(86) PCT No.: PCT/IB2008/052325

§ 371 (c)(1),
(2), (4) Date: Jan. 4, 2010

(87) PCT Pub. No.: WO2009/004514

PCT Pub. Date: Jan. 8, 2009

(65) Prior Publication Data

US 2010/0190591 A1 Jul. 29, 2010

(30) Foreign Application Priority Data

Jul. 4, 2007 (CH) ..... 1075/07

(51) Int. Cl.
*A63B 51/00* (2006.01)

(52) U.S. Cl. ..... 473/542; 473/540

(58) Field of Classification Search ..... 473/524, 473/540–542

See application file for complete search history.

(56) References Cited

U.S. PATENT DOCUMENTS

| | | | | |
|---|---|---|---|---|
| 1,559,986 | A | 11/1925 | Quick | |
| 2,456,023 | A | 12/1948 | Rosenbalm | |
| 3,547,440 | A | 12/1970 | Deer | |
| 3,664,669 | A * | 5/1972 | Latham et al. | 473/541 |
| 3,815,660 | A | 6/1974 | Gallagher et al. | |
| 3,874,667 | A * | 4/1975 | Gallagher et al. | 473/541 |
| 3,912,267 | A * | 10/1975 | Lyon | 473/541 |
| 3,966,207 | A * | 6/1976 | Pass | 473/541 |
| 3,981,502 | A * | 9/1976 | Portz | 473/541 |
| 4,005,862 | A | 2/1977 | Portz et al. | |
| 4,185,822 | A * | 1/1980 | Li | 473/541 |
| 4,366,959 | A * | 1/1983 | Lacoste | 473/541 |
| 4,441,712 | A * | 4/1984 | Guthke | 473/541 |
| 4,568,084 | A * | 2/1986 | Mott | 473/541 |
| 4,935,185 | A * | 6/1990 | Mott | 264/257 |
| 5,143,669 | A * | 9/1992 | Mott | 264/103 |
| 5,310,180 | A * | 5/1994 | Wu | 473/523 |
| 5,312,115 | A * | 5/1994 | Wu | 473/541 |
| 5,921,873 | A * | 7/1999 | Brown | 473/540 |
| 6,062,994 | A * | 5/2000 | Grimes et al. | 473/540 |
| 6,440,015 | B1 * | 8/2002 | Chang | 473/540 |
| 7,371,197 | B1 * | 5/2008 | Yu | 473/539 |
| 2002/0098924 | A1 * | 7/2002 | Houser et al. | 473/524 |
| 2009/0227403 | A1 * | 9/2009 | Chang | 473/540 |
| 2010/0190591 | A1 * | 7/2010 | Nagler | 473/535 |

FOREIGN PATENT DOCUMENTS

EP 1790392 A1 5/2007

* cited by examiner

*Primary Examiner* — Raleigh W. Chiu

(74) *Attorney, Agent, or Firm* — Janet Sleath; Speckman Law Group PLLC

(57) ABSTRACT

A novel ball-striking implement, in particular a tennis, squash or badminton racket, is described, with a head frame (1; 13) comprising an impact surface and also a stem which is formed integrally thereon and has a handle, the impact surface being determined by at least one string (3; 19) which is stretched crosswise and forms string portions fastened to the head frame substantially parallel to one another. The string portions in holding elements (2; 15) on the inside of the head frame are guided in such a manner that the string portions are positioned in a single plane forming the impact surface.

7 Claims, 3 Drawing Sheets

BALL-STRIKING IMPLEMENT

The present application claims priority to International Patent Application no. PCT/IB2008/052325, filed Jun. 12, 2008, which claims priority to Swiss Patent Application No. 1075/07, filed on Jul. 4, 2007.

FIELD OF THE INVENTION

The invention relates to a ball-striking implement, in particular a tennis, squash or badminton racket.

The invention relates to a ball-striking implement, in particular a tennis, squash or badminton racket, according to the preamble of patent claim 1.

BACKGOUND OF THE INVENTION

Conventional ball-striking implements made of plastics material have a head frame with a hollow profile, into which through-holes are drilled. Through these through-holes, the continuous string is stretched crosswise in loops. It is known that the through-holes, on the one hand, mechanically weaken the head frame and, on the other hand, chafe the string or string portions, as a result of which the string or string portions can tear there under high loads. Therefore, the through-holes are provided with individual eyes or eye bands made of a soft thermoplastic polymer.

Rackets are also known with a central strip made of thermoplastic polymer which is less hard than or as hard as the string. Hollow profiles made of fibre-reinforced plastics material are formed integrally on the central strip on both sides. The through-holes are in this case drilled into the central strip or prefabricated, for example with channels produced or pressed by injection moulding.

In order to avoid these drawbacks, EP-A-0142286 discloses a tennis racket which is manufactured by injection moulding and has shaped therein a wire with rectangular eyes into which the string is stretched crosswise. The rectangular eyes are in this case arranged in the plane of the impact surface. As the head frame is pear-shaped in its embodiment and the rectangular eyes are arranged with the upper rims substantially parallel to the inside of the head frame, the string is drawn during stringing into either the left or right corner of the respective eyes. It is therefore difficult, if not impossible, to achieve uniform stringing of the tennis racket. Furthermore, the respective string portions are as a result not all positioned in the same plane, as they are drawn around the eyes, making it almost impossible to achieve a stringing or impact surface that is precisely plane-parallel to the head frame.

SUMMARY OF THE INVENTION

The present invention is therefore based on the object of improving a ball-striking implement of the aforementioned type in such a way as to provide uniform stringing of the head frame, as a result of which it is immaterial whether the ball is hit at the center or at the ends of the racket.

This object is achieved by a ball-striking implement with a head frame comprising an impact surface and a stem which is formed integrally thereon and has a handle, the impact surface being determined by at least one string which is stretched crosswise and forms string portions fastened to the head frame substantially parallel to one another, wherein the string portions are guided in holding elements on the inside of the head frame in such a manner that the string portions are positioned in a single plane forming the impact surface.

BRIEF DESCRIPTION OF THE DRAWINGS

Further advantages of the invention emerge from the following description in which the invention is described in greater detail based on an exemplary embodiment illustrated in the schematic drawings, in which.

In the figures, like reference numerals are in each case used for like elements and, unless otherwise specified, initial explanations apply to all the figures.

DETAILED DESCRIPTION

Figure 1:
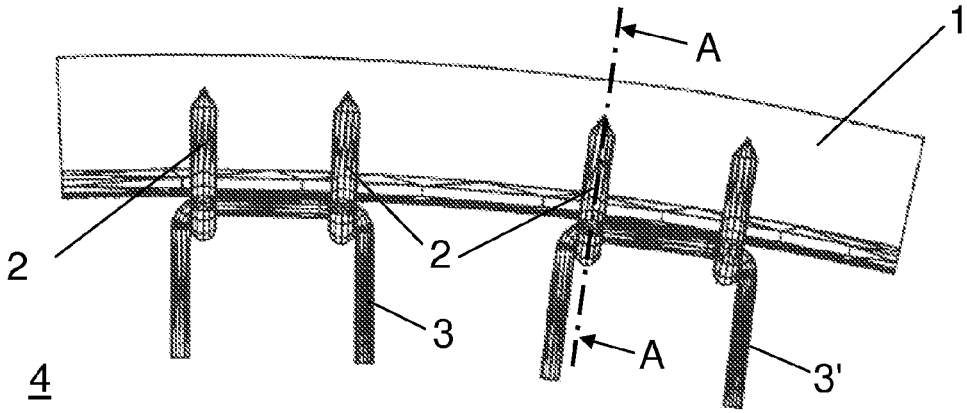
FIG. 1 shows a detail of a first head frame of a tennis racket.

FIG. 1 shows purely schematically a detail of a head frame 1 of a tennis racket known per se with four holding elements 2 in the form of eyes and strings 3 and 3' stretched respectively into two adjacent eyes. As may be seen, the eyes 2 are fastened to the head frame in such a way that the ring surface of the eyes 2 is positioned substantially perpendicularly to the plane 4 of the frame in which the tennis racket is strung.

Figure 2:
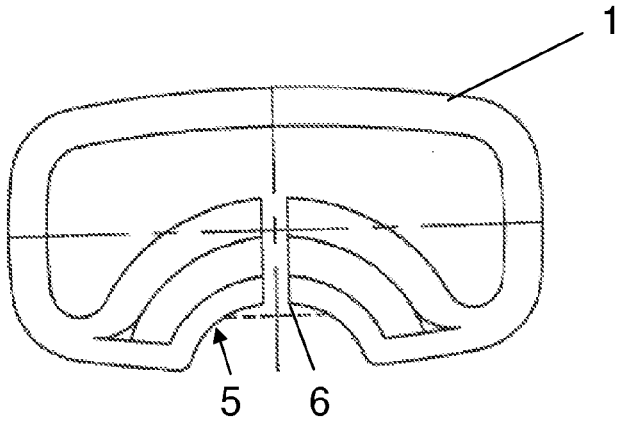
FIG. 2 is a cross section through the head frame along the line A-A in FIG. 1.

FIG. 2 is a cross section through the head frame 1 along the line A-A in FIG. 1. As may clearly be seen, the head frame 1 is hollow in its embodiment and has on the interior side a peripheral, sector of a ring-shaped, flat groove 5 having a borehole 6 which is formed perpendicularly thereto and serves to receive an eye 2.

Figure 3:
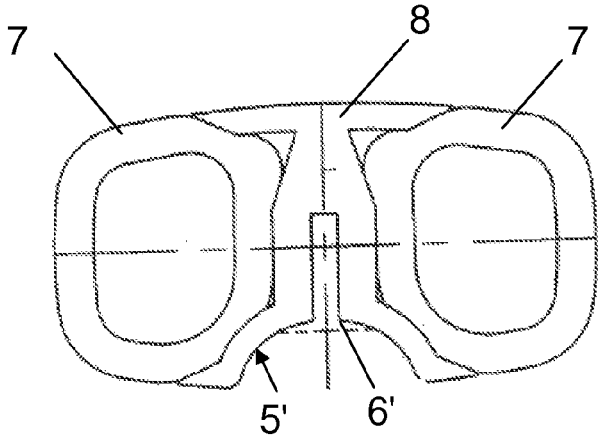
FIG. 3 is a cross section through the head frame in the region of what is known as the core.

FIG. 3 shows the head frame 1 in the region of what is known as the core of the tennis racket, in which the two frame parts have a smaller diameter and these frame parts 7 enclosed an H-shaped center part 8 which also has a similar sector of a ring-shaped, flat groove 5' and a borehole 6' for receiving an eye 2.

Figure 4:
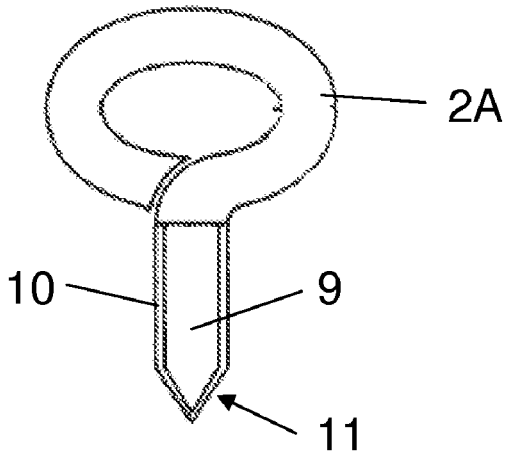
FIG. 4 to 6 show various embodiments of the inserted eyes.
Figure 5:
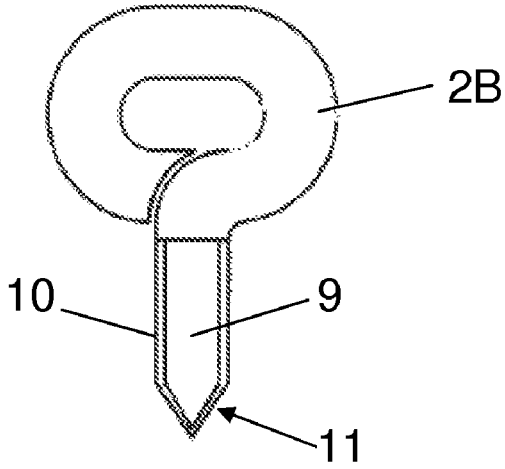
Figure 6:
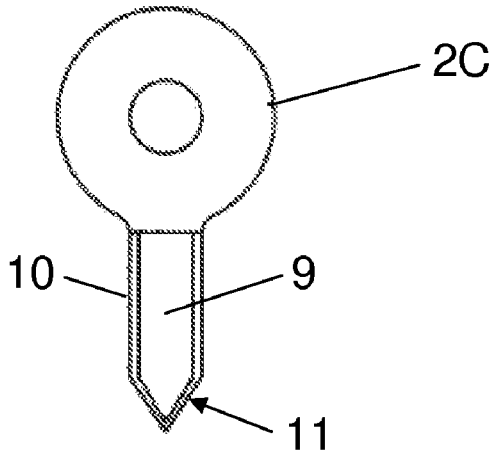

FIG. 4 shows an oval-shaped eye 2A, FIG. 5 shows an elliptical eye 2B and FIG. 6 shows a circular eye 2C. The stem 9 of these eyes 2A to 2C is in each case provided with a screw thread 10 and a front tip 11 in order to be inserted more easily into the borehole 6.

Figure 7:
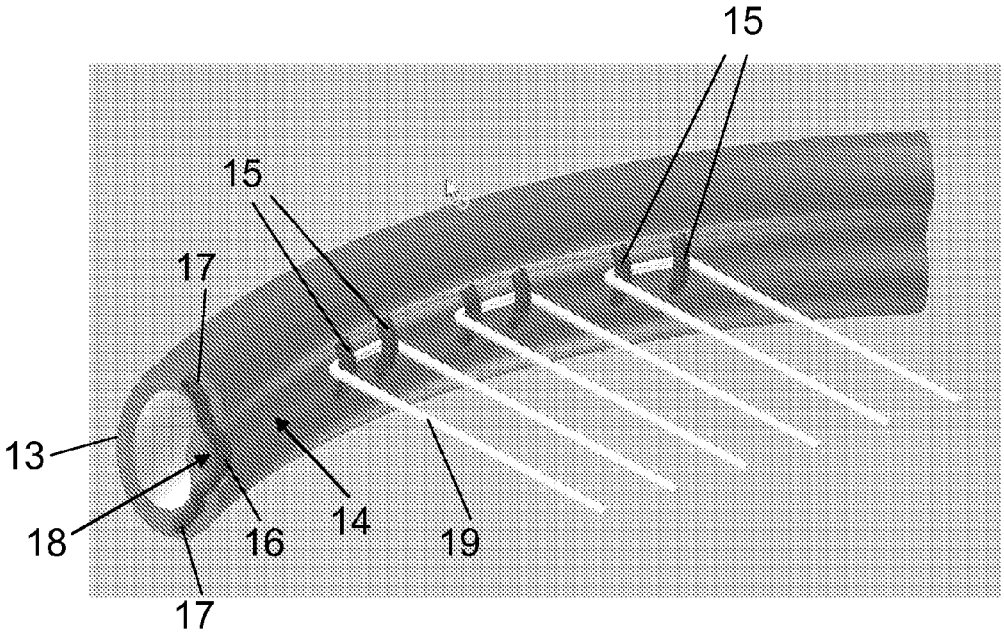
FIG. 7 is a perspective view of a detail of a second head frame.

FIG. 7 shows a second variant of a head frame 13 which is also hollow in its embodiment and has a sector of a circle-shaped, flat groove 14. Holding elements, in this case in the form of arcuate individual parts or bows 15 having a sector of a circle-shaped center part 16 and two curved legs 17 corresponding to the curvature of the head frame 13 in the region of the upper inner and lower inner edge. are also provided in this head frame. Thus the bow 15 forms with the flat groove 14 an oval opening 18 through which the string 19 of the stringing is passed. The bows 15 are fully integrated in the head frame 13 which is manufactured by laminating with what are known as prepregs or by injection moulding.

Figure 8:
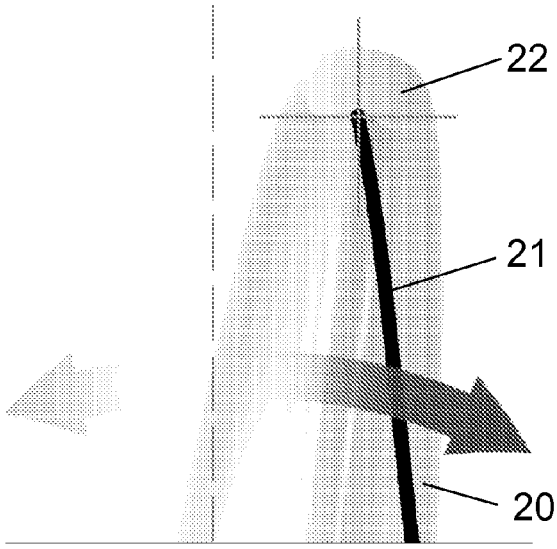
FIG. 8 is a schematic view of a conventional tennis racket at the moment of hitting the ball.

Now, FIG. 8 shows a frame detail 20 of a conventional tennis racket, with stringing through through-bore holes (not visible) provided in the head frame. As a result of the fact that the string 21 is fixed at its end 22 to the head frame 20, a ball striking the stringing will deflect the head frame, so that the ball bounces off not perpendicularly to the plane of the racket (rest position), but at an angle of approximately 80°. A professional tennis player can compensate for a deflection of this type of the head frame 20 using his wrist. The ability to precisely determine the direction of the ball and the speed of the ball requires daily practice and good visual judgment; only first-class tennis players are able to do this.

Figure 9:
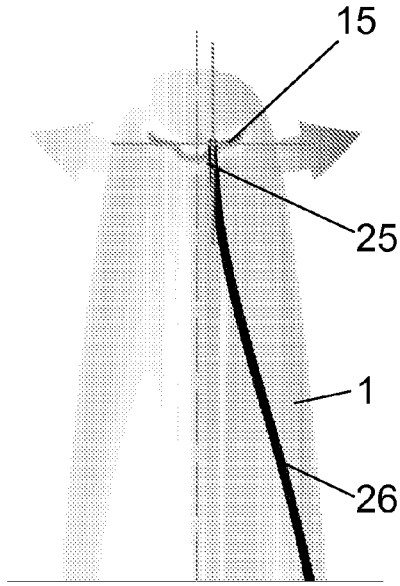
FIG. 9 is a schematic view of a tennis racket according to the invention at the moment of hitting the ball.

Now, FIG. 9 shows the head frame 1 of the tennis racket according to the present invention, the stretched-in end 25 of the string in the bow 15 performing a lateral movement caused by the impact of the tennis ball. As a result, the energy of the tennis ball is absorbed now by the stringing and no longer by a deflection of the head frame as in FIG. 8. The entire stringing or string bed is thus deflected laterally, allowing much more precise ball control, as the direction of impact is at all times perpendicular to the plane of the racket and the direction of the ball can thus be controlled by the tennis player with a very narrow spread range. It allows tennis players of all abilities to precisely guide the ball without exerting much force. Such stringing has the further advantage that vibrations of the head frame are markedly reduced as a result of the lateral deflection of the strings.

The head frame 1 or 13 of the tennis racket described in the present document is made from a suitable fibre-reinforced plastics material by injection moulding. The eyes 2 or bows 15 are selectively made from fibre-reinforced plastics material, metal, such as for example titanium, steel, non-ferrous metal, light metal such as aluminium or alloys thereof, or from a composite of these materials. This also allows the head frame to be made more aerodynamically advantageous.

The invention claimed is:

1. A ball striking implement with a head frame which is hollow and made from a fiber-reinforced plastics material, comprising an impact surface and a stem which is formed integrally thereon and has a handle, the impact surface being determined by at least one string which is stretched crosswise and forms string portions fastened to the head frame substantially parallel to one another by means or ring shaped holding elements provided directly on the inside of the head frame, wherein the holding elements are in the form of individual parts with a stem and a ring which are fastened by a ring surface to the head frame substantially perpendicularly to the impact surface, and wherein a plane defined by the ring shaped holding elements is substantially perpendicular to the impact surface, whereby the string portions are positioned in a single plane forming the impact surface, such that ends of the string portions perform a lateral movement in the ring shaped holding elements caused by the impact of a ball, which results in a lateral deflection of the entire impact surface.

2. The ball striking implement according to claim 1, wherein the ring is circular, oval or ellipsoidal in its formation.

3. The ball striking implement according to claim 1, wherein the head frame is made of plastics material and has an inner peripheral groove in which through-boreholes are formed for receiving the stems of the holding elements.

4. The ball striking implement according to claim 1, wherein the head frame consists in the region of the core of two oval-shaped tubular bodies which enclose an H-shaped center part the center part having blind boreholes for receiving the stems of the holding elements.

5. A ball striking implement with a head frame made from a fiber-reinforced plastics material, comprising an impact surface and a stern formed integrally thereon and having a handle, wherein the impact surface is determined by at least one string which is stretched crosswise and forms string portions fastened to the head frame substantially parallel to one another, the string portions being guided in holding elements on the inside of the head frame whereby the string portions are positioned in a single plane forming the impact surface and perform a lateral movement when impacted by a hall, wherein the holding elements are in the form of individual parts with a stem and a ring which are fastened by a ring surface to the head frame substantially perpendicularly to the impact surface, and wherein the head frame consists of two oval-shaped tubular bodies in a region of the core which enclose an H-shaped center part, the center part having blind boreholes for receiving the stems of the holding elements.

6. The ball striking implement according to claim 5, wherein the rings of the holding elements are circular, oval or ellipsoidal in shape.

7. The ball striking implement according to claim 5, wherein the head frame is hollow and has an inner peripheral groove in which through-boreholes are formed for receiving the stems of the holding elements.

* * * * *

UNITED STATES PATENT AND TRADEMARK OFFICE

CERTIFICATE OF CORRECTION

PATENT NO. : 8,333,672 B2
APPLICATION NO. : 12/667641
DATED : December 18, 2012
INVENTOR(S) : Hubert Nagler It is certified that error appears in the above-identified patent and that said Letters Patent is hereby corrected as shown below:

| Col. | Line(s) | Edits |
|---|---|---|
| 4 | 29 | Replace "when impacted by a hall" with --when impacted by a ball-- |

Signed and Sealed this
Twenty-sixth Day of February, 2013

Teresa Stanek Rea
*Acting Director of the United States Patent and Trademark Office*